US006830085B1

(12) United States Patent
Majewski

(10) Patent No.: US 6,830,085 B1
(45) Date of Patent: Dec. 14, 2004

(54) FUEL TANK INLET EXTENSION

(76) Inventor: Thomas A Majewski, 5 Oak La., Califon, NJ (US) 07830

( * ) Notice: Subject to any disclaimer, the term of this patent is extended or adjusted under 35 U.S.C. 154(b) by 0 days.

(21) Appl. No.: 10/812,319

(22) Filed: Mar. 29, 2004

(51) Int. Cl.[7] ..... B65B 39/00; B67C 11/04
(52) U.S. Cl. ..... 141/338; 141/331; 141/337
(58) Field of Search ..... 141/331–345, 141/199; 222/566–574

(56) References Cited

U.S. PATENT DOCUMENTS

| | | | | |
|---|---|---|---|---|
| 2,249,180 A | | 7/1941 | Scully et al. | |
| 3,136,295 A | | 6/1964 | Gramo | |
| 3,967,660 A | | 7/1976 | Russell | |
| 4,426,027 A | | 1/1984 | Maynard, Jr. | |
| 4,583,668 A | * | 4/1986 | Maynard, Jr. | 222/529 |
| 4,811,763 A | * | 3/1989 | Kupske | 141/44 |
| 5,195,567 A | | 3/1993 | Tyree, Jr. | |
| 5,445,196 A | | 8/1995 | Tyree, Jr. | |
| 5,515,891 A | | 5/1996 | Langlois | |
| 5,829,491 A | | 11/1998 | Bennett | |
| 5,975,154 A | | 11/1999 | Bennett | |
| 6,070,769 A | | 6/2000 | Hornsby | |
| 6,135,156 A | | 10/2000 | Donoho et al. | |
| 6,223,793 B1 | * | 5/2001 | Donoughe et al. | 141/338 |

* cited by examiner

*Primary Examiner*—Timothy L. Maust
(74) *Attorney, Agent, or Firm*—Michael I. Kroll

(57) ABSTRACT

An apparatus for a fuel tank filling and level monitoring device. The apparatus 10 provides an inexpensive and simple means of monitoring the fuel level in a tank 14 while it is being filled. A translucent cylinder 22 threaded on both ends 34, 36 is attached to the inlet 12 of the fuel tank 14. The operator 24 then inserts the nozzle 18 of the filling apparatus 20 into the end of the translucent cylinder and begins to fill the tank 14. When the tank 14 is filled to capacity the level begins to rise into the translucent cylinder 22 indicating the tank is full. The operator 24 then stops filling the tank 14, removes the nozzle 18 of the filling device 20 and applies the original cap from the fuel tank inlet to the end of the cylinder. Also disclosed are embodiments with a rigid body, a flexible body and as a component of a fuel tank.

10 Claims, 10 Drawing Sheets

FUEL TANK INLET EXTENSION

BACKGROUND OF THE INVENTION

1. Field of the Invention

The present invention relates generally to fuel tank filling and, more specifically, to fuel tank filling and level monitoring devices.

Portable fuel vessels or standard service station pumps are used to fill the fuel tank on a wide variety of landscape and small construction equipment. Either method requires the operator to place the nozzle of the filling device into the fuel tank inlet on the equipment. Monitoring the fuel level during filling is extremely difficult due to the small tank inlet being obstructed by the nozzle of the filling device. When the fuel level in the tank reaches the neck of the tank inlet the operator cannot react fast enough to prevent overflow. Fuel then spills onto the equipment and the surrounding area endangering the operator and the environment. Toxins from the fuel contaminate the ground water and cause permanent damage to the landscape. Fuel spilled on hot engines can cause serious personnel and extensive property damage. The present invention provides an inexpensive and simple means of monitoring the fuel level in a tank while it is being filled. A translucent cylinder threaded on both ends is attached to the inlet of the fuel tank. The operator the inserts the nozzle of the filling apparatus into the end of the translucent cylinder and begins to fill the tank. When the tank is filled to capacity the level begins to rise into the translucent cylinder indicating the tank is full. The operator then stops filling the tank, removes the nozzle of the filling device and applies the original cap from the fuel tank inlet to the end of the cylinder.

2. Description of the Prior Art

There are other fuel tank inlet extension devices designed for filling fuel tanks. Typical of these is U.S. Pat. No. 2,249,180 issued to F. P. Scully on Sep. 26, 1939.

Another U.S. Pat. No. 3,136,295 was issued to P. R. Gramo on May 21, 1962 and yet another was issued on Jul. 6, 1976 to James E. Russel as U.S. Pat. No. 3,967,660.

Another patent was issued to Walter P. Maynard Jr. on Jan. 17, 1984 as U.S. Pat. No. 4,426,027. Yet another U.S. Pat. No. 5,195,567 was issued to Lewis Tyree Jr. on Mar. 23, 1993. Another was issued to Lewis Tyree Jr. on Aug. 29, 1995 as U.S. Pat. No. 5,445,196 and still yet another was issued on May 14, 1996 to Joseph R. Langlois as U.S. Pat. No. 5,515,891.

Another patent was issued to Willard M. Bennett on Nov. 3, 1998 as U.S. Pat. No. 5,829,491. Yet another U.S. Pat. No. 5,975,154 was issued to Willard M. Bennet on Nov. 2, 1999. Another was issued to Gary Eugene Hornsby on Jun. 6, 2000 as U.S. Pat. No. 6,070,769 and still yet another was issued on Oct. 24, 2000 to James D. Donoho as U.S. Pat. No. 6,135,156.

U.S. Pat. No. 2,249,180

Inventor: Frank P. Scully, et al.

Issued: Jul. 15, 1941

In combination, a tank having a fill pipe and a vent pipe, means external of said tank separating the end of said fill pipe from the end of said vent pipe so that a normally audible sound such as might be produced by gas venting from said tank through a whistle in said vent pipe would be unaudible in the neighborhood of said fill pipe, a valve normally closing said vent pipe but adapted to open at a predetermined pressure, and a signaling pipe connected to said tank normally open and having an audible signaling device in series therewith, said signaling pipe having its outer end in such location that sound emanating there from may be heard in the neighborhood of said fill pipe, and means associated with the inner end of said signaling pipe for: altering the whistle when the liquid has risen to a predetermined.

U.S. Pat. No. 3,136,295

Inventor: Philip R. Gramo

Issued: Jun. 9, 1964

A liquid level signal device for attachment to the filler duct of a liquid storage tank comprising a generally cylindrical filler pipe, of substantially less diameter than said duct, which extends from the top of said duct through and to a substantial distance below the top wall of the tank with which it is associated, a generally circular disc with an eccentric hole in which the top end portion of said pipe fits and is secured to for a flange thereon, the outer edge portion of said flange being supported on the top of said duct, an intrusion tube between said filler duct and said pipe, said tube being so positioned that its lower end is disposed between the top wall of the tank and the lower end of said pipe at the elevation in said tank at which it is desired to obtain an indication of the rise of a liquid flowing into said tank, a removable whistle tube adapted to be fitted end to end with respect to said intrusion tube, and a whistle mounted on the outer end of said whistle tube.

U.S. Pat. No. 3,967,660

Inventor: James E. Russell

Issued: Jul. 6, 1976

To minimize gasoline spillage during the fueling of a pleasure boat, use is made of an overflow device that may be of a see-through plastic shaped to provide an adequate overflow chamber, which is positioned in the gas tank filler pipe, thereby enabling an overflow situation to be visually detected and appropriately attended to. Static electricity grounding during the fueling procedure, which ordinarily is achieved simply by establishing contact between the fueling nozzle and filler pipe, is, in this instance, achieved just as readily, even though the plastic device separates the fueling nozzle and filler pipe, merely upon the projection of the fueling nozzle into the overflow device.

U.S. Pat. No. 4,426,027

Inventor: Walter P. Maynard, Jr.

Issued: Jan. 17, 1984

A simpler, more efficient and convenient, flexible pouring spout for liquid containers has the ability to teach fill-points without employing a funnel. The spout, when inverted, stores easily within the container and is effectively sealed with the container neck in both the pouring and stored positions. A single threaded cover cap can engage threads on either end of the pouring spout to prevent leakage.

U.S. Pat. No. 5,195,567

Inventor: Lewis Tyree Jr.

Issued: Mar. 23, 1993

Filling units for supplying small tanks or the like with gasoline, kerosene, or other flowable materials which attach to an inlet to such a tank. When the filling unit is in a fill position, a displacer section occupies a substantial volume within the tank. It allows the person filling the tank to supply the liquid until the tank will accept no more and the liquid reaches a predetermined level in a funnel portion of the filler. Thereafter, manipulation of the displacer section vertically within the tank, as for example by sliding a section of the overall unit upward, accommodates all the liquid remaining in the funnel up to such predetermined level within the tank by occupying the volume previously occupied by the displacer section and thereby completing the filling of the tank to a full condition without any spillage. The overall unit may be such that it is intended to be removed from the tank after each filling operation, or it may be designed to fit permanently within a wide-mouth tank inlet and to be movable downward to a storage orientation which allows the unit to remain mounted in the tank inlet and covered by the protective cap that normally screws onto the inlet opening to close it.

U.S. Pat. No. 5,445,196

Inventor: Lewis Tyree, Jr.

Issued: Aug. 29, 1995

Filling units for supplying small tanks or the like with gasoline, kerosene, or other flowable materials which attach to an inlet to such a tank. When the filling unit is in a fill position, a displacer section occupies a substantial volume within the tank and allows the person filling the tank to supply the liquid until the tank will accept no more and the liquid reaches a predetermined level in a funnel portion of the filler. Thereafter, manipulation of the displacer section, as for example by withdrawing a section of the overall unit upward opening a valve or movement within the tank itself, causes all the liquid remaining in the funnel up to such predetermined level to be accommodated within the tank by occupying the volume previously occupied by the displacer section and thereby completing the filling of the tank to a full condition without any spillage. The overall unit may be such that it is intended to be removed from the tank after each filling operation (and preferably stored in an optional, integral storage compartment), or it may be designed to fit permanently within a tank inlet and to be movable downward to a storage orientation, which allows the replacing of the protective screw cap that normally closes the tank.

U.S. Pat. No. 5,515,891

Inventor: Joseph R. Langlois

Issued: May 14, 1996

An apparatus is provided for preventing the spillage of fuel into the water or onto a marine vessel when filling a fuel tank on the vessel. A vent line is coupled between the fuel tank and a vent port of the vessel, at least one valve assembly is coupled within the vent line, and an overflow container is coupled within the vent line between the valve assembly and the vent port. The valve assembly defines a drain hole for permitting small quantities of fuel, gases and/or vapors to pass through the valve assembly and into the overflow container. A fill container defines an inlet port for receiving a fuel nozzle to fill the fuel tank with fuel, and an outlet port coupled in fluid communication with a fill line for the passage of fuel between the fill container and the fuel tank. A by-pass line is coupled between the fill container and the overflow container for the passage of overflow fuel through the fill container, and an indicator system is mounted within the fill container for signaling to an attendant when the fuel tank is filled. Upon filling the fuel tank with fuel, the overflow fuel backs up into the fill container, and in turn flows through the by-pass line and into the overflow container. The backed-up fuel also activates the indicator system for signaling to the attendant to turn off the fuel nozzle, and the drain hole permits the backed-up fuel in the fill container and fill line to drain downwardly into the fuel tank.

U.S. Pat. No. 5,829,491

Inventor: Willard M. Bennett

Issued: Nov. 3, 1998

A fuel overflow prevention system for substantially eliminating fuel spillage both due to over-filling during fueling and due to fuel expansion in fuel tanks. The device includes a fuel discharge preventor and a nozzle adapter that work together during re-fueling to allow displacement by fuel of gases within the fuel tank until such time that the fuel reaches a predetermined level in the tank. The predetermined level is chosen through the geometry of the fuel discharge preventor so as to provide sufficient space for thermal expansion of the fuel without subsequent fuel spillage. The fuel discharge preventor also contains a valve that closes upon attainment of the predetermined fuel level and, together with nozzle adapter, causes a pressure build-up within the filling fuel tank so as to positively actuate the automatic turn-off features of the standard fuel pump nozzle utilized U.S. Pat. No. 5,975,154

Inventor: Willard M. Bennett

Issued: Nov. 2, 1999

A fuel overflow prevention system for substantially eliminating fuel spillage both due to over-filling during fueling and due to fuel expansion in fuel tanks. The device includes a fuel discharge preventor and a nozzle adapter that work together during re-fueling to allow displacement by fuel of gases within the fuel tank until such time that the fuel reaches a predetermined level in the tank. The system also includes a feedback coupling to permit the transfer of excess fuel from the preventor back to the fuel inlet, particularly when an automatic shutoff nozzle is employed. The system further includes an extension tube to allow remote location of a housing containing the discharge prevention valving of the invention. The discharge prevention housing only permits venting of vapors to the atmosphere and prevents liquid fuel discharge. A vent tube coupling permits venting of those vapors to a standard marine atmospheric vent.

U.S. Pat. No. 6,070,769

Inventor: Gary Eugene Hornsby

Issued: Jun. 6, 2000

A filler assembly includes a flexible hose having a predetermined length and a helical wire reinforcement within the hose to prevent collapse. A first coupling at one end of the hose attaches the filler assembly to a portable fuel jug. The coupling includes a threaded end and a cup-shaped end for receiving a barb attached to the flexible hose. A second coupling at the other end of the tubing adapts the filler assembly to the fuel tank of a vehicle. The second coupling includes a cup-shaped portion for receiving a second barb that fits within the hose. The second coupling also includes threaded, cylindrical portion that is sealed by a threaded cap. The cylindrical portion of the second coupling can be long or short, bent or straight, threaded or unthreaded U.S. Pat. No. 6,135,156

Inventor: James D. Donoho, et al

Issued: Oct. 24, 2000

The tube closure comprises a cap and a nut which work in concert with each other to effectively seal a nipple at the end of a threaded tube or pipe and which facilitate removal of the cap. The cap has a flared end portion, a narrowed neck portion, a head portion, and an inner cylindrical sealing surface which engages the nipple. The cap is removably engaged within the nut with the nut at the neck portion, and is sealingly engaged on a cylindrical surface of the nipple. The cap may be removed from the nut by withdrawing the head through the nut, with an axial separation force. Removal of the cap from the nipple requires an axial cap removal force. The required axial separation force is greater than the cap removal force. The engagement of the cap within the nut allows the unscrewing of the nut to provide an axial force on the cap to disengage the cap from the nipple without separating the nut from the cap.

While these fuel tank inlet extension devices may be suitable for the purposes for which they were designed, they would not be as suitable for the purposes of the present invention, as hereinafter described.

SUMMARY OF THE PRESENT INVENTION

The present invention discloses a fuel tank filling and level monitoring device. The present invention provides an inexpensive and simple means of monitoring the fuel level in a tank while it is being filled. A translucent cylinder threaded on both ends is attached to the inlet of the fuel tank. The operator then inserts the nozzle of the filling apparatus into the end of the translucent cylinder and begins to fill the tank. When the tank is filled to capacity the level begins to rise into the translucent cylinder indicating the tank is full. The operator then stops filling the tank, removes the nozzle of the filling device and applies the original cap from the fuel tank inlet to the end of the cylinder. Also disclosed are embodiments with a rigid body, a flexible body and as a component of a fuel tank.

A primary object of the present invention is to provide a means of monitoring the level of a fuel tank when being filled Another object of the present invention is to provide a device that prevents fuel spillage when filling a fuel tank.

Yet another object of the present invention is to provide a translucent cylinder for visually monitoring the level in a fuel tank.

Still yet another object of the present invention is to provide a threaded cylindrical element to attached the translucent cylinder to the existing inlet on a fuel tank.

Another object of the present invention is to provide a threaded cylindrical element to attach the existing tank cap to the translucent cylinder.

Yet another object of the present invention is to provide a flexible translucent cylinder for visually monitoring the level in a fuel tank.

Still yet another object of the present invention is to provide a retractable translucent cylinder as one of the components of a fuel tank assembly Additional objects of the present invention will appear as the description proceeds.

The present invention overcomes the shortcomings of the prior art by providing a simple inexpensive means of visually monitoring the level of fuel in a tank and preventing spillage.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
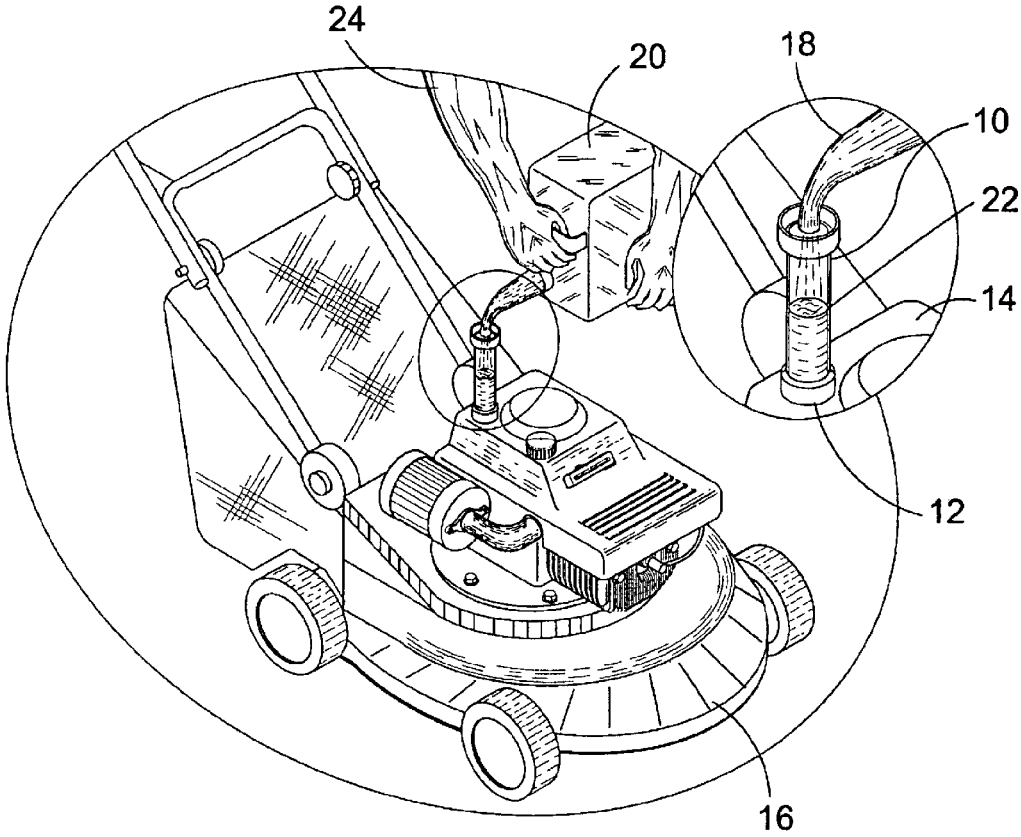
FIG. 1 is an illustrative view of the present invention

With regard to reference numerals used, the following numbering is used throughout the drawings.

10 present invention
12 inlet to tank
14 fuel tank
16 lawn mower
18 nozzle
20 fuel can
22 translucent cylinder
24 user
26 fuel spill
28 rigid translucent cylinder
30 flexible translucent cylinder
32 integral component of fuel tank
34 male threaded element
36 female threaded element
38 bore
40 gas cap

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10. The present invention 10 comprises a fuel tank inlet 12 extension and provides a device to monitor the fuel level when filling a tank 14. Spilling fuel is a common occurrence when filling the fuel tank 14 on a lawn mower 16 or any other type of outdoor equipment. Short tank inlets hinder any visual monitoring of the fuel level when obstructed by the nozzle 18 of a fuel can 20. The preferred embodiment of this device 10 is comprised of a translucent cylinder 22 with means of being attached to the fuel tank inlet 12 and also has a feature to accommodate the existing fuel tank cap. Once attached to the tank inlet 12, the user 24 can visually monitor the fuel levels in the cylinder 22 and therefore the level in the tank 14.

Figure 2:
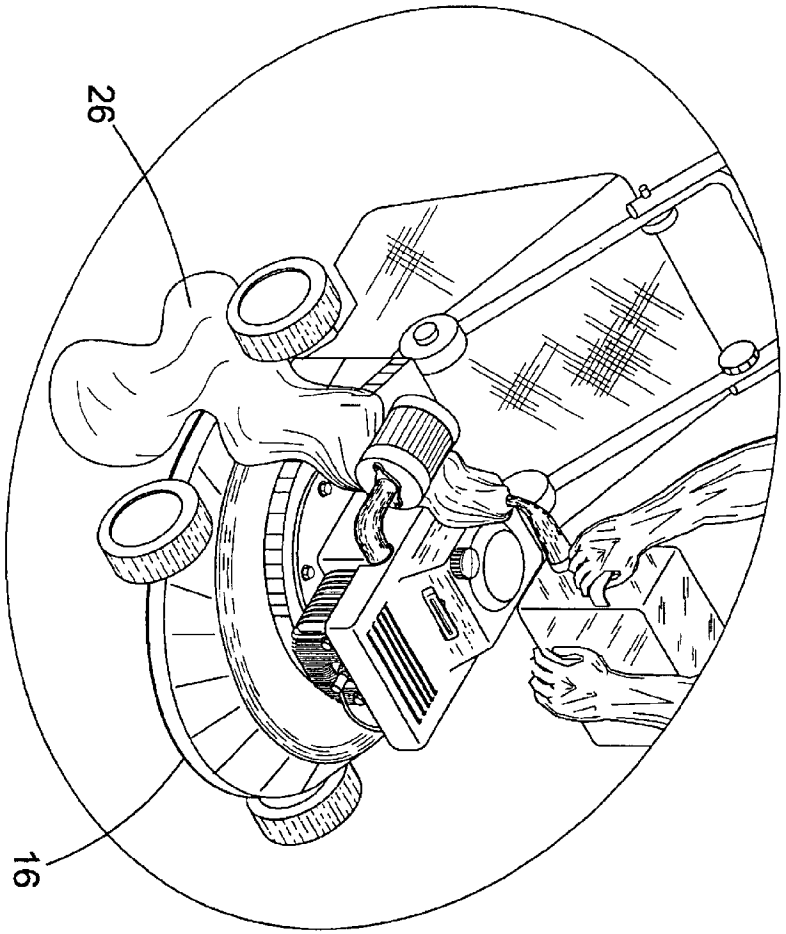
FIG. 2 (PRIOR ART)
FIG. 2 is an illustrative view of prior art.

Turning to FIG. 2, shown therein is an illustrative view of the prior art. The prior art provides no means of preventing environmental contamination, personal injury or property damage caused by spilling fuel 26. Toxins in fuel and fuel mixtures contaminate among other things the ground water and can cause permanent damage to a landscape. Fuel fires ignited by hot engine parts of lawnmowers 16 can cause serious personal injury and property damage. The present invention provides a simple inexpensive means of monitoring the level in a fuel tank and prevents spilling fuels.

Figure 3:
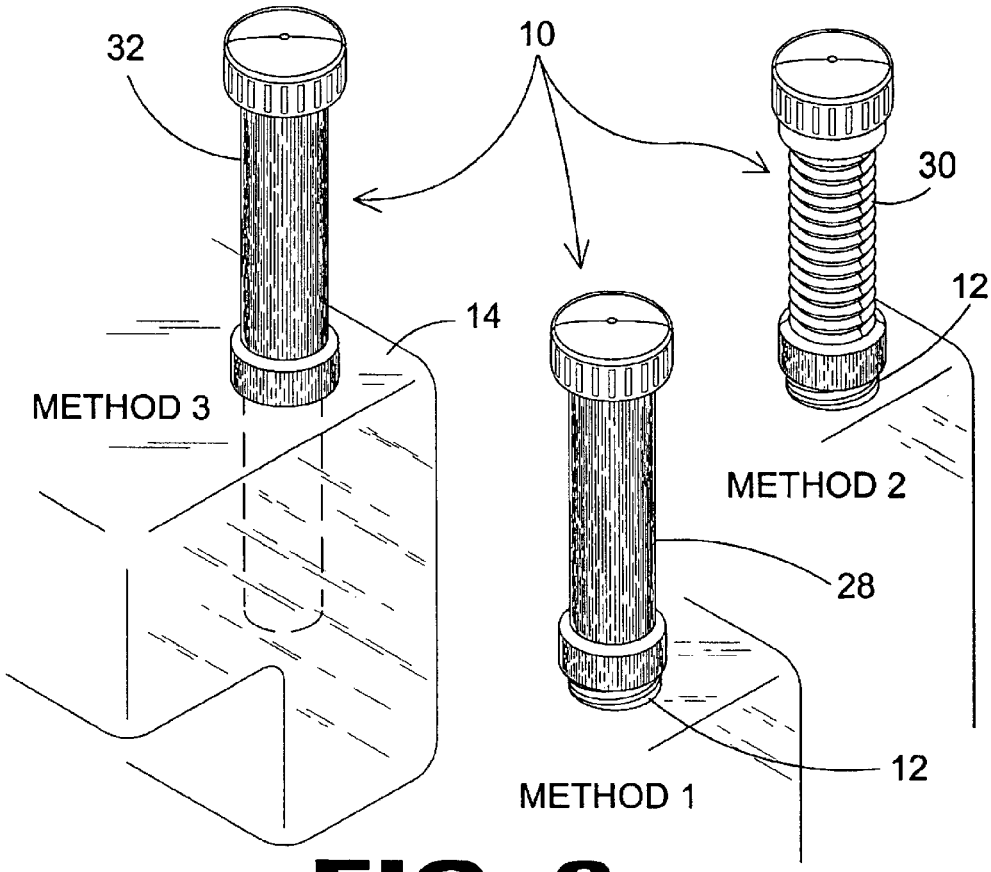
FIG. 3 is an illustrative view of various application methods of the present invention.

Turning to FIG. 3, shown therein illustrates various applications of the present invention 10. The filler-monitoring device 10 can be used as an optional attachment to an existing tank inlet or an integral component of a fuel tank. Method 1 shows a rigid translucent cylinder 28 attached to a fuel tank inlet 12. Method 2 depicts a flexible, translucent cylinder 30 attached to a fuel tank inlet 12. Method 3 describes the present invention as an integral component 32 of the fuel tank 14.

Figure 4:
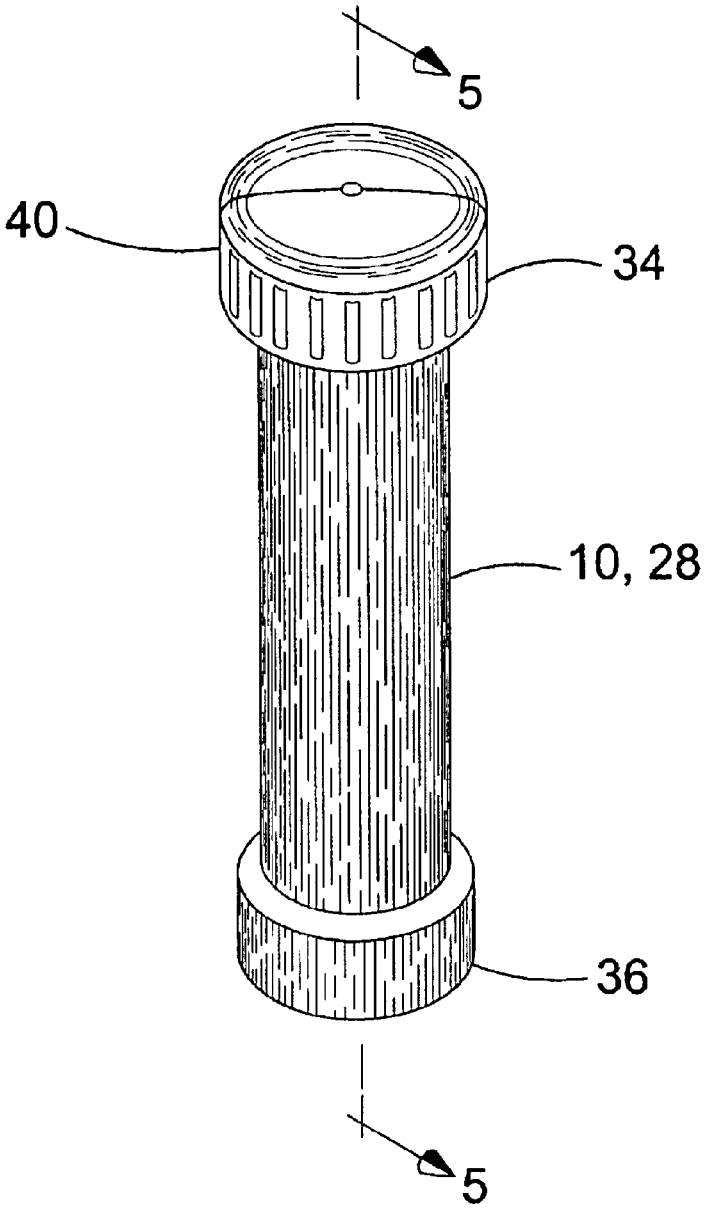
FIG. 4 is an isometric view of the present invention.

Turning to FIG. 4, shown therein is an illustrative view of the present invention showing one application of the present invention 10 comprised of a rigid translucent cylindrical body 28 with threaded elements 34, 36 on both ends. A female threaded element 36 is used to attach the cylinder to the inlet of the fuel tank. The male threaded element 34 on the opposite end is used for attachment of the existing gas cap 40 from the tank inlet. The cylindrical body 28 has a concentric internal bore throughout the body that provides a conduit for the fuel.

Figure 5:
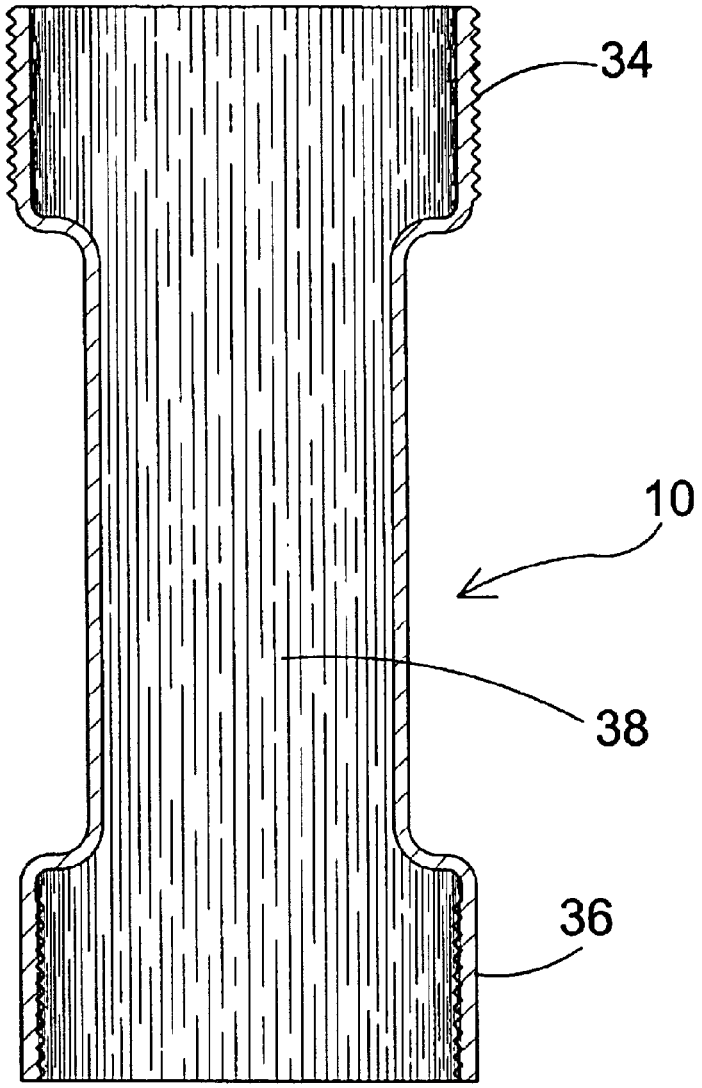
FIG. 5 is a cross sectional view of the present invention

Turning to FIG. 5, shown therein is a cross sectional view of the present invention 10 as indicated in FIG. 4, of the present invention. Shown are the threaded ends 34, 36 and internal bore 38.

Figure 6:
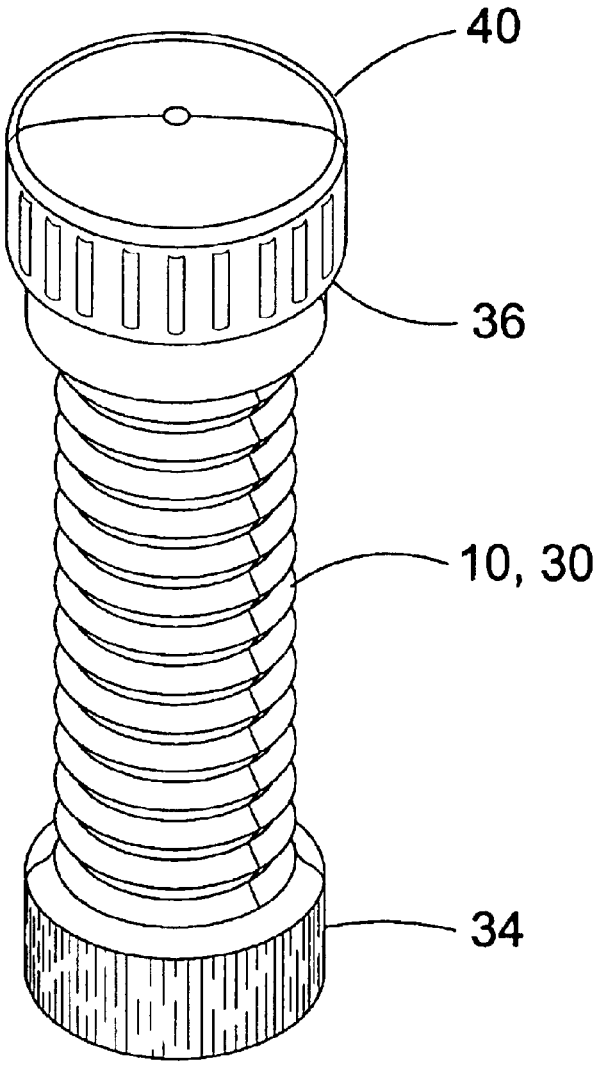
FIG. 6 is an illustrative view of the present invention.

Turning to FIG. 6, shown therein is an illustrative view of the present invention 10 showing one application of the present invention 10 is comprised of a flexible translucent cylindrical body 30 with threaded elements 34, 36 on both ends. A female threaded element 34 is used to attach the cylinder to the inlet of the fuel tank. The male threaded element 36 on the opposite end receives the existing gas cap 40 from the tank inlet. The cylindrical body 30 has a concentric internal bore throughout the body that provides a conduit for the fuel.

Figure 7:
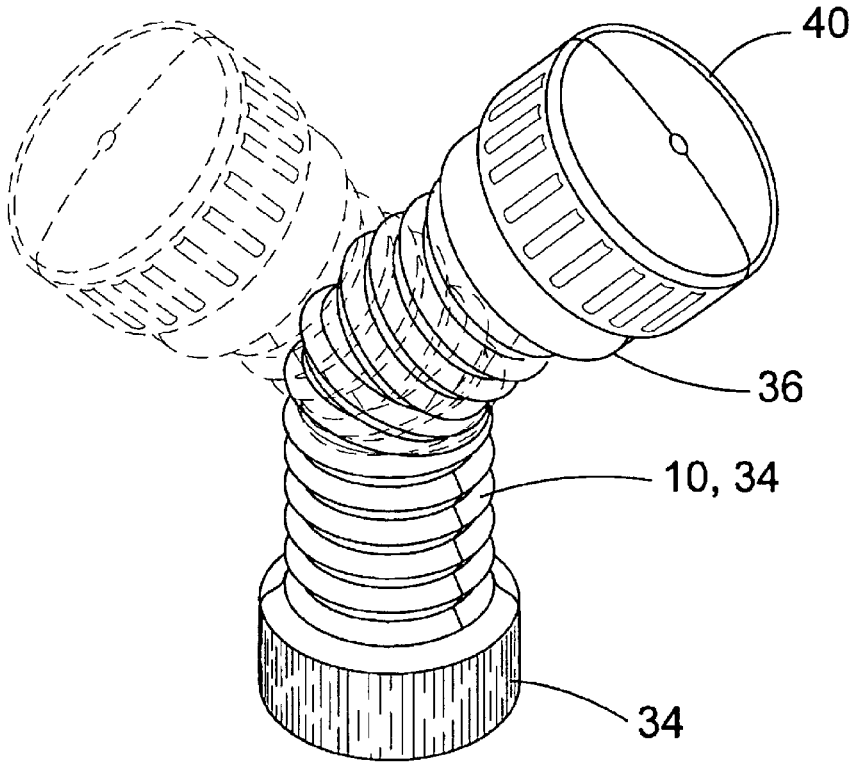
FIG. 7 is an illustrative view of the present invention.

Turning to FIG. 7, shown therein is an illustrative view of the present invention 10 depicting flexibility of the cylinder 34 for easier access to the inlet of the cylinder and thereby the fuel tank. Other previously disclosed elements are also shown.

Figure 8:
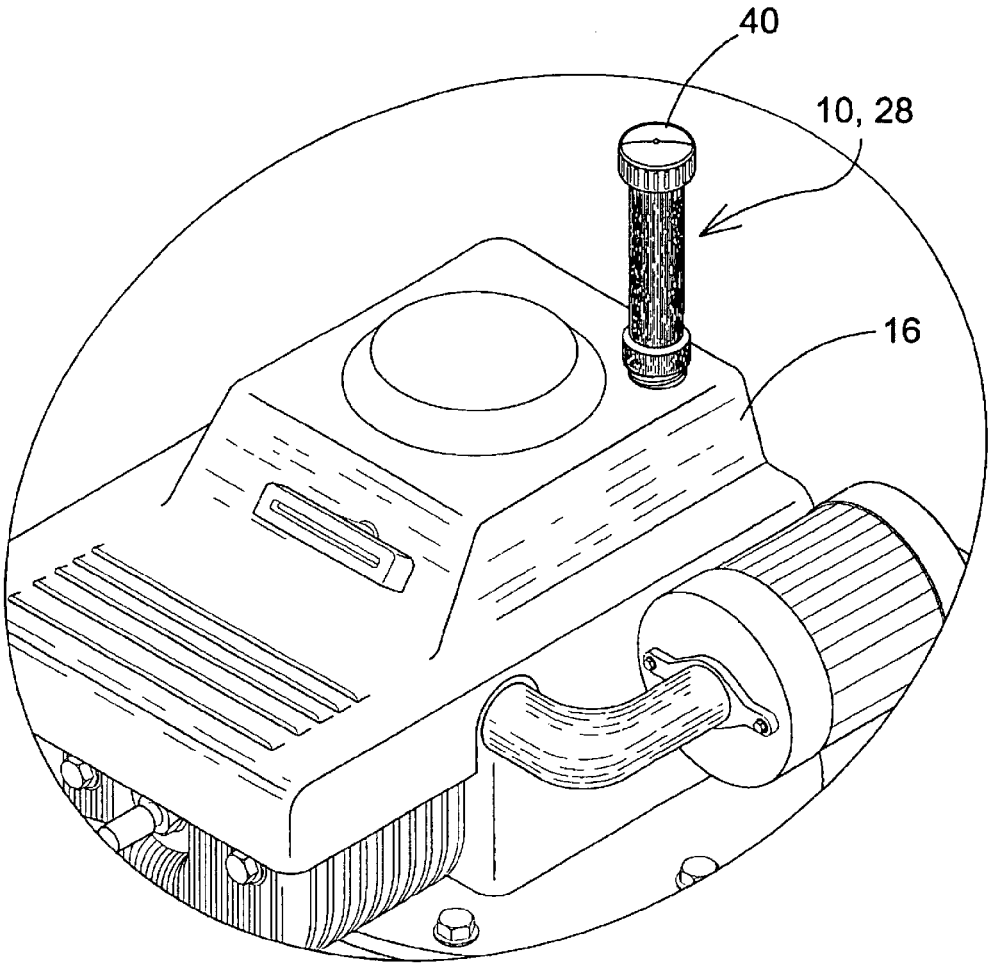
FIG. 8 is an illustrative view of the present invention in use.

Turning to FIG. 8, shown therein illustrates the preferred embodiment of the present invention 10 as referenced in FIG. 3, as Method 1 with rigid body 28, and FIGS. 4, and 5. The device 10 is attached to the fuel tank inlet of a lawn mower 16. Other previously disclosed elements are also shown.

Figure 9:
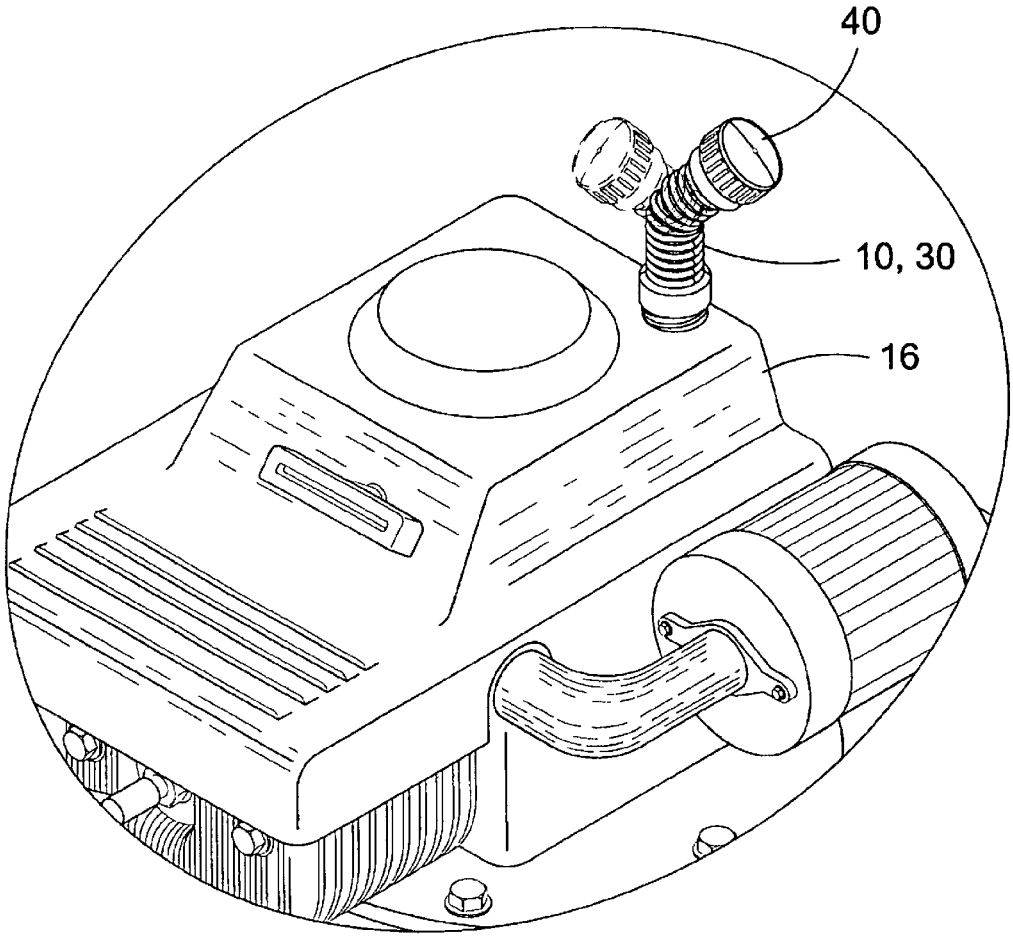
FIG. 9 is an illustrative view of the present invention in use.

Turning to FIG. 9, shown therein is an alternate embodiment of the present invention as referenced in FIGS. 3, 6 and 7, as Method 2 with flexible body 30. The device 10 is attached to the fuel tank inlet of a lawn mower 16. Other previously disclosed elements are also shown.

Figure 10:
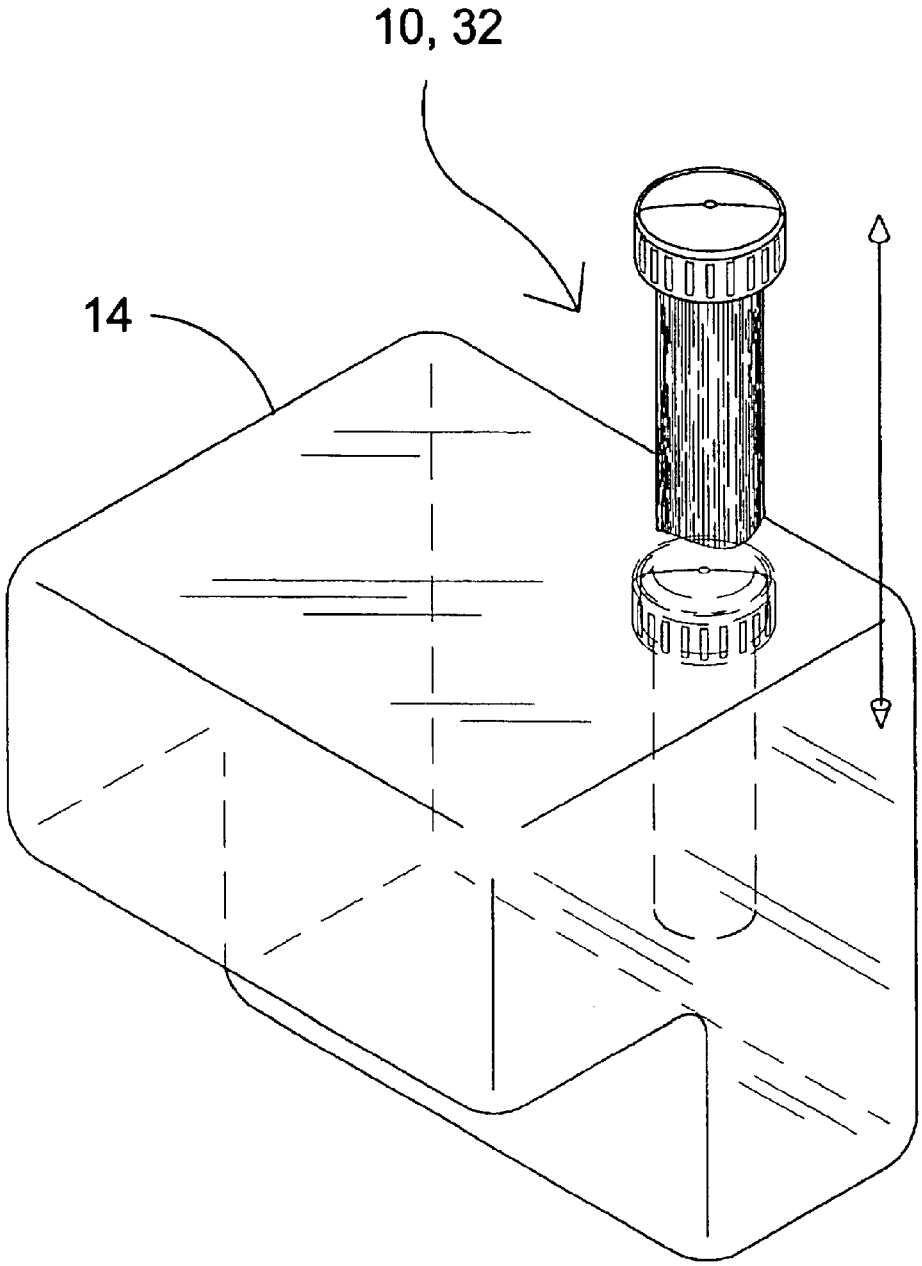
FIG. 10 is an illustrative view of the present invention in use.

Turning to FIG. 10, shown therein is a supplemental embodiment of the present invention 10 as referenced in FIG. 3 as Method 3 as an integral component 32 of the fuel tank 14. The design of the present invention 10 is incorporated as an integral component of the fuel tank assembly 14. The inlet extension 10, 32 can be retracted into the tank 14 when not in use or extended for filling.

I claim:

1. An extension for use in filling a fuel tank, the fuel tank having a male threaded inlet and a fuel cap thereon, comprising:

a) a cylindrical body having first and second opposing ends, wherein said body has a bore therein, wherein said body is translucent to permit a user to see the level of fuel therein;

b) female threads being disposed on said first end of said body, wherein said female threads are internal said bore to permit the body to be attached to the male threads on the inlet to the fuel tank; and, c) male threads being disposed on said second end of said body, wherein said male threads are external said body to permit the fuel cap of the fuel tank to be placed thereon.

2. The extension of claim 1, wherein said cylindrical body is flexible to permit it to bend in various directions.

3. The extension of claim 2, wherein said female threads are complementarily sized as the male threads of the fuel tank inlet.

4. The extension of claim 3, wherein said male threads are complementarily sized as the male threads of the fuel tank inlet.

5. The extension of claim 4, wherein said male threads and said female threads are complementarily sized as the male threads of a conventionally sized fuel tank inlet of a lawnmower.

6. An extension for use in filling a fuel tank, the fuel tank having a male threaded inlet and a fuel cap thereon, comprising:

a) a cylindrical body having first and second opposing ends, wherein said body has a bore therein, wherein said body is translucent to permit a user to see the level of fuel therein;

b) wherein said first end of said body is adapted to be slidably inserted into the inlet of the fuel tank to permit the body to be inserted into the inlet of the fuel tank when not in use; and, c) male threads being disposed on said second end of said body, wherein said male threads are external said body to permit the fuel cap of the fuel tank to be placed thereon when the extension is being used to fill the fuel tank.

7. The extension of claim 6, wherein said body is made integral to the fuel tank.

8. The extension of claim 7, wherein said cylindrical body is flexible to permit it to bend in various directions.

9. The extension of claim 8, wherein said male threads are complementarily sized as the male threads of the fuel tank inlet.

10. The extension of claim 9, wherein said male threads are complementarily sized as the male threads of a conventionally sized fuel tank inlet of a lawnmower.

* * * * *